United States Patent [19]

Deussen

[11] 4,330,067

[45] May 18, 1982

[54] CONTAINER CLOSURE WITH CHILDPROOF LOCK AND ORIGINAL PACKAGE SEAL

[75] Inventor: Werner Deussen, Eltville, Fed. Rep. of Germany

[73] Assignee: Stella KG Werner Deussen, Eltville, Fed. Rep. of Germany

[21] Appl. No.: 206,623

[22] Filed: Nov. 13, 1980

[30] Foreign Application Priority Data

Nov. 19, 1979 [GB] United Kingdom ..... 7939906

[51] Int. Cl.[3] ..... B65D 55/02

[52] U.S. Cl. ..... 215/220; 215/251; 215/258; 215/252

[58] Field of Search ..... 215/220, 251, 252, 258, 215/256

[56] References Cited

U.S. PATENT DOCUMENTS

| | | | |
|---|---|---|---|
| 3,944,102 | 3/1976 | Grav | 215/220 X |
| 4,004,704 | 1/1977 | Hilaire | 215/258 X |
| 4,165,813 | 8/1979 | Babiol | 215/220 |
| 4,286,633 | 9/1981 | Herr | 215/220 X |

FOREIGN PATENT DOCUMENTS

| | | | |
|---|---|---|---|
| 972713 | 8/1975 | Canada | 215/220 |

*Primary Examiner*—George T. Hall
*Attorney, Agent, or Firm*—Karl F. Ross

[57] ABSTRACT

A container closure comprising cap means adapted for a turning on and off connection with holding means provided at the container opening to be closed, such as screw connection or bayonet connection, said cap means containing an outer cap means having elements for manupulation and an inner cap means having elements of said turning on and off connection and being mounted substantially within said outer cap means to be turned in and to be pushed into said outer cap means to a limited extent against the force of a spring, cooperating turning coupling elements, provided at said inner and outer cap means to be in engagement with each other when said inner cap means has been pushed axially into the outer cap means, cooperating supporting means at said inner and outer cap means comprising a supporting band extending round the circumference at the open end of said inner cap means to substantially improve supporting and guiding the said outer and inner cap means for their relative movements, and cooperating catch elements to secure the said inner cap means against its removal from the outer cap means, and an original package securing means adapted to be destroyed by first opening the container closure. Ratchet-like locking elements may be provided additionally at said inner and outer cap means independently from said turning coupling elements to lock said inner and outer cap means for turning said closure on said holding elements of the container and to form a freewheel connection in the direction of turning off said closure from the holding elements of the container.

15 Claims, 2 Drawing Figures

CONTAINER CLOSURE WITH CHILDPROOF LOCK AND ORIGINAL PACKAGE SEAL

FIELD OF THE INVENTION

My invention relates to a container closure which is secured against unwarranted opening, particularly by children, having a turning cap consisting of an outer and an inner cap, for example a screwcap.

BACKGROUND OF THE INVENTION

Container closures of this type have been disclosed in German Patent No. 23 03 020, in which the inner cap has an internal thread and can be pushed into the outer cap to a limited extent by being turned against the force of a spring and is secured against being removed from the outer cap in the axial direction. In these devices, the outer cap and inner cap both have coupling members designed to be turned, which can only transmit torque in the direction of opening the closure if the inner cap has been pushed into the outer cap.

OBJECTS AND SUMMARY OF THE INVENTION

The problem underlying the present invention, on the other hand, is that closures of this type should in addition be equipped with a simple original package securing means for the contents. This securing means should be destroyed when and only when the closure member has been opened. This means that the package securing means must not be destroyed or damaged when the outer cap is turned without being coupled with the inner cap. When, on the other hand, the coupling between the inner and outer cap has been established so that the inner cap turns with the outer cap, the package securing means should be surely destroyed when the closure cap is turned.

Therefore it is a main object of my invention to provide a container closure comprising a rotary closure cap means adapted to cooperate with holding means and with a circumferential collar means, both of them being provided at the container adjacent to its opening to be closed, said rotary closure cap means consisting of an outer cap and an inner cap, in which the said inner cap carrying the elements cooperating with the said holding means of the container is mounted for a turning movement within the said outer cap and to be pushed into the outer cap to a limited extent against the force of a spring and is secured against its removal from the said outer cap, the outer cap and the inner cap having turning coupling means which are designed such that they can only transmit torque from the outer cap to the inner cap when the inner cap has been pushed axially into the outer cap, wherein the said inner cap has a supporting band extenting round the circumference at its outer, open end, which band projects axially outwardly from the open edge of the said outer cap by an amount greater than the maximum possible depth to which the inner cap can be pushed into the outer cap and an original packing securing fitted over the said circumferential collar means of the container is attached to the free circumferential edge of the said supporting band by a tear-off connection.

By providing this supporting band at the lower, open end of the inner cap, the outer cap is much more firmly guided over the inner cap, both for pushing the inner cap into the outer cap in the axial direction and for turning the outer cap in relation to the inner cap. This improved support between the outer cap and the inner cap ensures that the inner cap will only participate in the turning movement of the outer cap in the opening direction when the coupling between the inner cap and the outer cap has been deliberately established. The arrangement of the original package securing means in the form of a ring on the supporting band of the inner cap and its attachment to the band by a tear-off connection ensure that the seal will only be destroyed when the outer cap is turned in the opening direction after it has been coupled to the inner cap, in other words when the closure cap is deliberately turned to open it.

Accidental destruction of or damage to the original package securing means due to parts of the outer or inner cap catching on the seal is prevented by the supporting band and by arranging the seal at the free edge of the band.

It is a further object of my invention to provide a container closure comprising a rotary closure cap means adapted to cooperate with holding means provided at the container adjacent to its opening to be closed, said rotary closure cap means consisting of an outer cap and an inner cap, in which said inner cap carrying the elements cooperating with said holding means of the container is mounted for a turning movement within the said outer cap and to be pushed axially into the outer cap to a limited extent against the force of a spring and is secured against its removal from the said outer cap, said outer cap and said inner cap having turning coupling means which are designed such that they will only transmit torque from the outer cap to the inner cap when the inner cap has been pushed axially into the outer cap, wherein the said inner cap has a supporting band extenting around the circumference at its lower, open end, which band projects axially outwardly from its open edge of the said outer cap by an amount greater than the maximum possible depth to which the inner cap can be pushed to the outer cap, and additional locking means are provided at the said inner cap and the said outer cap which are adapted to engage together for transmitting a torque from the said outer cap to the said inner cap in only that one direction of rotation which is for closing the container, the said additional locking means being further adapted for the said engagement for only one direction of rotation independent of the said pushing the inner cap into the outer cap.

Further it is an object of the present invention to provide a container closure of a kind as defined above, in which original packing securing means are combined with additional locking means for transmitting a torque only in one direction and in which the said additional locking means are adapted such that when the outer cap is rotated in the freewheel direction it can not transmit sufficient torque from the outer cap to the inner cap for tearing off the said original packing securing means.

BRIEF DESCRIPTION OF THE DRAWINGS

An embodiment of the invention will now be described by way of example with reference to the drawing, in which.

SPECIFIC DESCRIPTION

Figure 1:
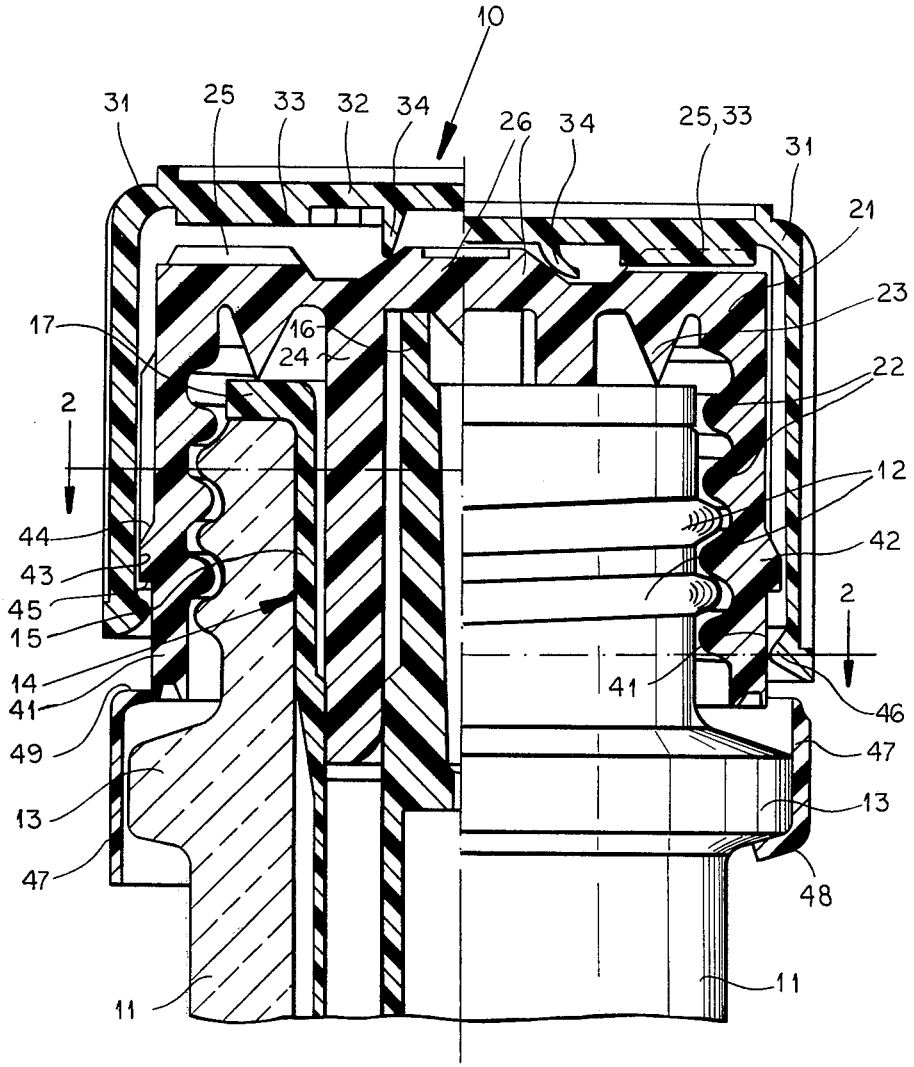
FIG. 1 is an axial sectional view of a closure device according to the invention on a glass medicine bottle, the left half of the drawing showing the outer cap and inner cap in the closed position of rest while the right half of the drawing shows the two caps pushed together.

The embodiment illustrated is a screwcap 10 for medicine bottles made of glass. The neck 11 of the bottle has the usual outer thread 12 and a conventional ring 13 for transport. A dropper 14 of known type may be inserted in the opening of the neck 11 of the bottle. This dropper 14 comprises a circumferential wall 15, a central air tube 16 an a peripheral flange 17 with which it is seated on the top edge of the bottle neck 11. The bottle closure cap 10 comprises an inner cap 21 having a internal thread 22 and at the inside of its end wall an axially extending ringlike sealing rib 23 seating onto the flange 17. In addition, the inner cap in its inner space has a central, axially extending tubular part 24 which fits between the circumferential wall 15 and air tube 16 of the dropper 14.

The inner screwcap 21 is situated inside the outer cap 31 which is axially displaceable in relation to the inner screwcap 21. At its end face, the inner screwcap 21 carries a ring of coupling elements 25 and a central truncated cone-shaped part 26. Conforming to these parts, the outer cap carries on the internal surface of its base 32 a ring of counter-coupling elements 33 and a ring of curved spring elements 34 which surround the truncated cone 26 of the inner screwcap 21.

The circumferential wall of the inner screwcap 21 is continuous at its open end with a cylindrical supporting band 41 which projects axially below the opening edge of the outer cap 31. At the level where the supporting band 41 is continuous with the circumferential wall of the inner screwcap 21, the band ends in a locking collar 42 which has a cylindrical peripheral surface 43 forming a ring, a side portion 44 sloping towards the circumferential wall of the inner cap and, at the lower end adjoining the supporting band 41, a shoulder 45 lying in a plane substantially at rightangles to the axis of the cap. The outer cap carries a locking ring 46 at its open edge, which ring is substantially triangular in cross-section, thus making a line of contact extending round the surface of the supporting band 41.

Figure 2:
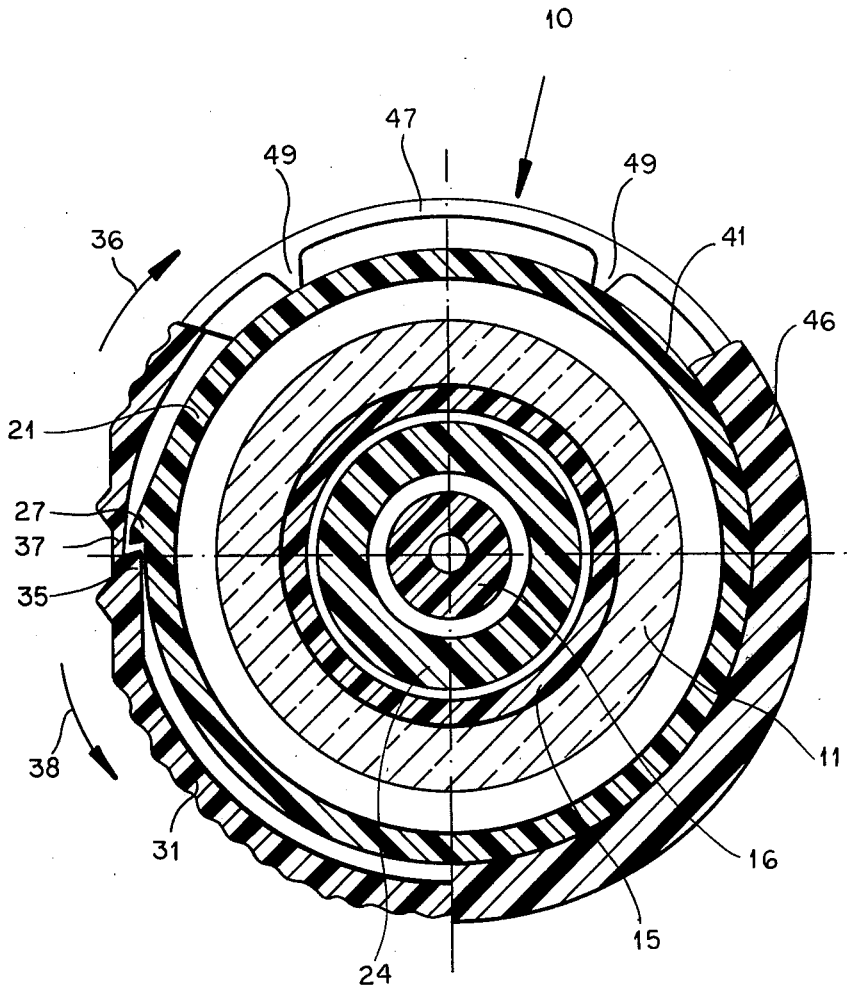
FIG. 2 is a section of FIG. 1 taken on the line 2—2.

Attached to the free end of the supporting band 41 is an original package seal 47 in the form of a ring the lower end 48 of which is turned in, using heat, below the underside of the transporting ring 13 after the bottle has been filled. The connection between the supporting band 41 and the package sealing ring 47 is formed by a plurality of radially extending connecting webs 49 distributed round the circumference (see in particular also FIG. 2). Axial displacement of the inner screwcap 21 from the position shown in FIG. 1 is possible only by unscrewing the cap from the bottle neck 11. This movement, however, tears the connecting webs 49 and separates the package sealing ring 47 from the supporting band 41.

In the example illustrated, the closure member 10 is secured against unwarranted opening even after it has already been opened and closed again. As can be seen in FIG. 1, the curbed spring elements 34 normally keep the inner screwcap 21 and the outer cap 31 in the position in relation to each other shown in the left part of FIG. 1, in which the coupling elements 25 and counter-coupling elements 33 are disengaged. To unscrew the cap from the neck 11 of the bottle, it is necessary to push down the outer cap so that the inner cap is pushed axially into the outer cap against the action of the spring elements 34 spreading out on the truncated cone element 26 until the coupling members 25 and counter-coupling members 33 engage. Only then is it possible for a torque to be transmitted from the outer cap 31 to the inner screwcap 21 to open the closure cap 10. Above all, it is only in this manner that sufficient torque can be transmitted from the outer cap 31 to the inner cap 21 to tear the webs. 49.

In order that the closure device 10 may be closed without pressing together of the outer cap 31 and inner cap 21, the outer cap 31 has locking ribs 35 on the internal surface of its circumferential wall (FIG. 2) cooperating with locking ribs 27 on the external surface of the circumferential wall and the inner cap 21. These locking ribs 27 and 35 each are provided with a substantially radially extending engagement flank and a flat sliding flank, such that the engagement flanks of the cooperating locking ribs 27 and 35 are opposite to each other for the one direction of rotation and the sliding flanks of the cooperating locking ribs 27 and 35 are opposite to each other for the second direction of rotation (see FIG. 2). Thus it is only when the closure device is turned clockwise as indicated by arrow 36 in FIG. 2 that these ribs 27 and 35 engage so that they can transmit sufficient torque from the outer cap 31 to the inner cap 21 to screw the whole cap firmly to the neck 11 of the bottle. When the outer cap 31 is turned anti-clockwise, i.e. to unscrew the cap from the neck of the bottle, the flat sides of the ribs 27 and 35 slide away from each other. This sliding movement is facilitated by making the circumferential wall of the outer cap 31 in the form of a thin, yielding spring element 37 in the region of the locking ribs 35. When the outer cap is turned anti-clockwise (as indicated by arrow 38), it is therefore impossible to transmit sufficient torque to the inner cap 21 to release the cap from the external thread 12 of the neck 11 of the bottle, let alone to tear off the connecting webs 49 of the original package sealing ring 47.

Having thus disclosed my invention, what I claim is:

1. In a container closure comprising a rotary closure cap means adapted to cooperate with holding means and circumferential collar means, both of them being provided at the container adjacent to its opening to be closed, the said rotary closure cap means consisting of an outer cap and an inner cap, in which the said inner cap carrying the elements cooperating with the said holding means of the container for closing the cap, for example carrying an internal thread, further said inner cap being mounted for a turning movement within the said outer cap and to be pushed into the outer cap to a limited extent against the force of a spring means and is secured against its removal from the said outer cap, the said outer cap and the said inner cap having turning coupling means which are designed such that they will only transmit torque from the outer cap to the inner cap when the inner cap has been pushed axially into the outer cap the improvement, wherein (a) the said inner cap has a supporting band extending round the circumference at its open end, which supporting band projects axially outwardly from the open edge of the said outer cap by an amount greater than the maximum possible depth to which the inner cap can be pushed into the outer cap, and (b) an original package securing means fitted over the said circumferential collar means of the container is attached to the free circumferential edge of the supporting band by a tear-off connection.

2. The improvement defined in claim 1, having a ratchet connection between the outer cap and inner cap which locks when the cap is turned in the closing direction and overrides when it is turned in the opening direction, and wherein the tear-off Connection is constructed to absorb larger torques than those which can be produced by overriding of the ratchet connection.

3. The improvement defined in claim 1 wherein the original package seal forms a radially outwardly projecting shoulder at the free edge of the supporting band and tear-off webs are formed in the region of this shoulder to join the supporting band to the seal.

4. The improvement defined in claim 1, claim 2 or claim 3 wherein at the level where the supporting band becomes the circumferential wall of the inner cap proper, it has a radially projecting locking collar the underside of which engages with a locking ring on the internal surface of the outer cap.

5. The improvement defined in claim 4, wherein the locking collar has a sloping surface on the side facing the closed end of the inner cap.

6. The improvement defined in claim 4, wherein the locking collar has a surface situated in a plane substantially at rightangles to the axis of the cap on the side facing the open end of the inner cap, said surface being separated by a sharp edge from the annular circumferential surface of the collar.

7. The improvement defined in claim 4, wherein the locking collar has a substantially cylindrical annular circumferential surface which slides over the internal circumferential surface of the outer cap.

8. The improvement defined in claim 4, wherein the locking ring has a substantially triangular profile on the internal surface of the outer cap so as to make linear contact with the surface of the supporting band.

9. The improvement defined in claim 4 wherein the locking ring and locking collar both form unbroken circumferences.

10. The improvement defined in claim 4 wherein the locking ring is formed on the internal surface of the opening edge of the outer cap.

11. A container closure comprising a rotary closure cap means adapted to cooperate with holding means provided at the container adjacent to its opening to be closed, said rotary closure cap means consisting of an outer cap and an inner cap, in which the said inner cap carrying the elements cooperating with the said holding means of the container for closing the cap, for example carrying an internal thread, said inner cap being mounted for a turning movement within the said outer cap and to be pushed into the outer cap to a limited extent against the force of a spring means and is secured against its removal from the said outer cap, said outer cap and said inner cap having turing coupling means which are designed such that they will only transmit torque from the outer cap to the inner cap when the inner cap has been pushed axially into the outer cap, wherein (a) the said inner cap has a supporting band extending around the circumference at its open end, which supporting band projecting axially outwardly from the open edge of the said outer cap by an amount greater than the maximum possible depth to which the inner cap can be pushed into the outer cap, and (b) additional locking means are provided at the said inner cap and the said outer cap which are adapted to engage together for transmitting a torque from the said outer cap to the said inner cap in only than one direction of rotation which is provided for closing the container closure, the said additional locking means being further adapted for such engagement for only one direction of rotation independent of the said pushing the inner cap into the outer cap.

12. A container closure according to claim 11, wherein further at least one locking rib is provided on the external surface of the circumferential wall of the said inner cap and at least one locking rib is provided at the inner surface of the circumferential wall of the said outer cap, and the said locking ribs being adapted to engage together for transmitting a torque for rotating the said inner cap with respect to the said container only in the one direction provided for closing the said container closure.

13. A container closure according to claim 12, wherein the said locking ribs of the inner and outer cap each are provided with a substantially radially extending engagement flank and a flat sliding flank such that the engagement flanks of the cooperating locking ribs are opposite to each other for the one direction of rotation and the sliding flanks of the cooperating locking ribs are opposite to each other for the second direction of rotation.

14. A container closure according to claim 11 and provided for containers having a circumferential collar means additionally to their holding means adjacent to the container opening to be closed, wherein further an original package securing means fitted over the said circumferential collar means of the container is attached to the free circumferential edge of the said supporting band of the said inner cap by a tear-off connection, said additional locking means being adapted to be impossible, when turning the said outer cap, to transmit sufficient torque to the inner cap to release the cap from the said holding means of the container and to tear-off the connection between the free circumferential edge of the said supporting band and the said original package securing means.

15. A container closure according to claim 14, wherein the said additional locking means comprises at least one locking rib provided on the external surface of the circumferential wall of the said inner cap and at least one locking rib provided at the inner surface of the circumferential wall of the said outer cap, said locking ribs each being provided with a substantially radially extending engagement flank and a flat sliding flank, such, that the engagement flanks of the cooperating locking ribs are opposite to each other for the one direction of rotation of the said outer cap and the sliding flanks of the cooperating locking ribs are opposite to each other for the second direction of rotation of the said outer cap, and forming yielding spring means in the circumferential wall of the said outer cap in the region of the locking rib or locking ribs respectively provided in the said outer cap.

* * * * *